US010108116B2

(12) United States Patent
Tsukamura

(10) Patent No.: US 10,108,116 B2
(45) Date of Patent: Oct. 23, 2018

(54) IMAGE FORMATION SYSTEM WITH SHEET COOLING SECTION AND IMAGE FORMATION METHOD

(71) Applicant: Konica Minolta, Inc., Chiyoda-ku, Tokyo (JP)

(72) Inventor: Shinichi Tsukamura, Yamanashi (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 15/492,478

(22) Filed: Apr. 20, 2017

(65) Prior Publication Data

US 2017/0315482 A1 Nov. 2, 2017

(30) Foreign Application Priority Data

Apr. 28, 2016 (JP) ..... 2016-091518

(51) Int. Cl.
*G03G 21/20* (2006.01)
*G03G 15/20* (2006.01)

(52) U.S. Cl.
CPC ..... *G03G 15/2039* (2013.01); *G03G 21/206* (2013.01)

(58) Field of Classification Search
CPC ..... G03G 15/2039; G03G 21/206
See application file for complete search history.

(56) References Cited

U.S. PATENT DOCUMENTS

2005/0196204 A1* 9/2005 Funato ..... G03G 15/2014 399/341
2007/0222805 A1* 9/2007 Moscato ..... B41J 3/543 347/12
2009/0016785 A1* 1/2009 Haan ..... G03G 15/0131 399/301
2010/0020119 A1* 1/2010 McConville ..... B41J 2/0057 347/9
2010/0129107 A1* 5/2010 Takehara ..... G03G 21/206 399/92
2010/0178071 A1* 7/2010 Barton ..... G03G 15/2039 399/69
2011/0064468 A1* 3/2011 Kawahata ..... G03G 15/2053 399/122
2011/0094440 A1* 4/2011 Barton ..... G03G 15/6573 118/69
2011/0222890 A1* 9/2011 Kikushima ..... G03G 15/2039 399/69

(Continued)

FOREIGN PATENT DOCUMENTS

JP 01266557 A * 10/1989
JP 2010181724 A 8/2010

OTHER PUBLICATIONS

Machine translation of JP2010181724.*

*Primary Examiner* — David Bolduc
(74) *Attorney, Agent, or Firm* — Cantor Colburn LLP

(57) ABSTRACT

An image formation system includes a cooling section that cools a sheet in a period after a toner image is fixed on a first surface by a first fixing section and before the toner image is formed on a second surface of the sheet by a second image forming apparatus, and a hardware processor that controls a cooling operation of the cooling section in accordance with a parameter representing a temperature of an image forming section of the second image forming apparatus.

23 Claims, 5 Drawing Sheets

(56) References Cited

U.S. PATENT DOCUMENTS

| | | | | |
|---|---|---|---|---|
| 2011/0267396 | A1* | 11/2011 | Yamamoto | B41J 3/60 347/16 |
| 2013/0293646 | A1* | 11/2013 | Stephens | B41J 3/543 347/102 |
| 2015/0241823 | A1* | 8/2015 | Fukai | G03G 15/2032 399/70 |
| 2015/0346659 | A1* | 12/2015 | Nagayama | G03G 15/2039 101/424.1 |
| 2016/0091844 | A1* | 3/2016 | Matsuo | G03G 15/2039 399/68 |
| 2016/0334749 | A1* | 11/2016 | Iwasaki | G03G 15/6573 |
| 2017/0090362 | A1* | 3/2017 | Katada | G03G 15/2039 |

* cited by examiner

IMAGE FORMATION SYSTEM WITH SHEET COOLING SECTION AND IMAGE FORMATION METHOD

CROSS REFERENCE TO RELATED APPLICATIONS

The present invention claims priority under 35 U.S.C. § 119 to Japanese Application No. 2016-091518, filed Apr. 28, 2016, the entire content of which is incorporated herein by reference, the disclosure of which including the specification, drawings and abstract is incorporated herein by reference in its entirety.

BACKGROUND OF THE INVENTION

1. Field of the Invention

The present invention relates to an image formation system and an image formation method.

2. Description of Related Art

In recent years, tandem-type image formation systems that perform double-sided printing and the like with two image forming apparatuses connected in tandem are practically used. For example, a toner image is formed on the first surface of (for example, the front surface) a sheet by an image forming apparatus of the preceding stage (preceding machine), and a toner image is formed on the second surface (for example, the rear surface) of the sheet by an image forming apparatus of the succeeding stage (succeeding machine). With this configuration, productivity can be improved in comparison with a configuration in which double-sided printing is performed by one image forming apparatus. Such tandem-type image formation systems are generally employed in production print machines designed for high productivity.

In the above-mentioned image formation systems, a sheet on which a toner image is formed on the first surface in the preceding machine is heated by the fixing section, and accordingly the temperature of the sheet supplied to the succeeding machine is high. As a result, the temperature of the image forming section of the succeeding machine to which the sheet having a high temperature is supplied increases, and image defects due to toner fusing or the like are easily caused.

In view of this, a technique has been proposed for suppressing temperature rise of the image forming section by cooling the sheet heated by the fixing section of the preceding machine to an appropriate temperature at a position between the fixing section of the preceding machine and the image forming section of the succeeding machine (see, for example, Japanese Patent Application Laid-Open No. 2010-181724).

However, in the above-mentioned technique of cooling the sheets, the fixing temperature (the temperature enough to provide a heat value required for melting the toner on the sheet) of the fixing section of the succeeding machine is required to be increased by the value reduced by the cooling process. This disadvantageously results in, in addition to increase in power consumption due to the cooling process, increase in power consumption due to increase in heat value supplied at the time of fixation of the succeeding machine. Accordingly, from a view point of energy saving, it is desired to minimize the cooling process in the image formation system.

SUMMARY OF THE INVENTION

An object of the present invention is to provide an image formation system and an image formation method which can minimize the cooling process.

To achieve the abovementioned object, an image formation system of a tandem type reflecting one aspect of the present invention is to perform an image formation process on a sheet with two image forming apparatuses connected with each other in tandem, the image formation system including: a first image forming apparatus including a first image forming section that forms a toner image on a first surface of a sheet, and a first fixing section that fixes the toner image formed on the first surface; a second image forming apparatus including a second image forming section that forms a toner image on a second surface of the sheet on which the toner image is formed on the first surface thereof, and a second fixing section that fixes the toner image formed on the second surface; a cooling section that cools the sheet in a period after the toner image is fixed on the first surface by the first fixing section and before the toner image is formed on the second surface of the sheet by the second image forming apparatus; and a hardware processor that controls a cooling operation of the cooling section in accordance with a parameter representing a temperature of the second image forming section.

Desirably, in the image formation system, the hardware processor sets a setting value of a fixing temperature in the second fixing section of a case where the cooling section is operated, to a value higher than a setting value of the fixing temperature of a case where the cooling section is not operated.

Desirably, in the image formation system, the parameter representing the temperature is a surface temperature of an image bearing member of the second image forming section.

Desirably, in the image formation system, the parameter representing the temperature is thermal expansion of an image bearing member of the second image forming section.

Desirably, in the image formation system, the hardware processor controls the cooling operation of the cooling section in accordance with an image formation condition.

Desirably, in the image formation system, the hardware processor switches between a first mode and a second mode, the first mode being a mode in which the cooling operation of the cooling section is controlled in accordance with the parameter representing the temperature, the second mode being a mode in which, in accordance with a temperature of the sheet on which the toner image is fixed on the first surface thereof by the first fixing section, the cooling operation of the cooling section is controlled such that a heat dissipation amount of the sheet is constant.

Desirably, in the image formation system, the hardware processor switches between the first mode and the second mode in accordance with an image formation condition.

Desirably, in the image formation system, in accordance with the parameter representing the temperature during the cooling operation of the cooling section, the hardware processor lengthens a time period for conveying the sheet from the first fixing section to the second image forming section.

Desirably, in the image formation system, in accordance with the parameter representing the temperature during the cooling operation of the cooling section, the hardware processor lengthens a path for conveying the sheet from the first fixing section to the second image forming section.

Desirably, in the image formation system, in accordance with the parameter representing the temperature during the cooling operation of the cooling section, the hardware processor reduces a conveyance speed of the sheet from the first fixing section to the second image forming section.

Desirably, in the image formation system, the second fixing section includes a heating source that heats the toner image formed on the second surface, and the hardware processor controls a heating operation of the second fixing section by changing a duty ratio of an on/off pattern of a half-wave cycle in the heating source.

An image formation method reflecting another aspect of the present invention is intended for performing an image formation process on a sheet by a first image forming apparatus and a second image forming apparatus connected with each other in tandem, the image formation process including: forming a toner image on a first surface of the sheet and fixing the toner image formed on the first surface in the first image forming apparatus; cooling the sheet in accordance with a parameter representing a temperature of an image forming section of the second image forming apparatus in a period after the toner image is fixed on the first surface and before the toner image is formed on a second surface of the sheet; and forming a toner image on the second surface of the sheet on which the toner image is formed on the first surface thereof, and fixing the toner image formed on the second surface in the second image forming apparatus.

A computer-readable recording medium reflecting another aspect of the present invention stores a program for causing a computer to execute the image formation method according.

Desirably, in the recording medium, in the image formation process, a setting value of a fixing temperature in fixation of the toner image formed on the second surface of a case where the sheet is cooled is set to a value higher than a setting value of a fixing temperature of a case where the sheet is not cooled.

Desirably, in the recording medium, the parameter representing the temperature is a surface temperature of an image bearing member at a time when a toner image is formed on the second surface.

Desirably, in the recording medium, the parameter representing the temperature is thermal expansion of an image bearing member at a time when a toner image is formed on the second surface.

Desirably, in the recording medium, in the image formation process, a cooling operation for cooling the sheet is controlled in accordance with an image formation condition.

Desirably, in the recording medium, in the image formation process, switching between a first mode and a second mode is performed, the first mode being a mode in which a cooling operation for cooling the sheet is controlled in accordance with the parameter representing the temperature, the second mode being a mode in which, in accordance with a temperature of the sheet on which the toner image is fixed on the first surface thereof, the cooling operation is controlled such that a heat dissipation amount of the sheet is constant.

Desirably, in the recording medium, in the image formation process, the switching between the first mode and the second mode is performed in accordance with an image formation condition.

Desirably, in the recording medium, in the image formation process, a time period for conveying the sheet from the fixing of the toner image formed on the first surface to the forming of the toner image on the second surface is lengthened in accordance with the parameter representing the temperature during the cooling operation for cooling the sheet.

Desirably, in the recording medium, in the image formation process, a path for conveying the sheet from the fixing of the toner image formed on the first surface to the forming of the toner image on the second surface is lengthened in accordance with the parameter representing the temperature during the cooling operation for cooling the sheet.

Desirably, in the recording medium, a conveyance speed of the sheet from the fixing of the toner image formed on the first surface to the forming of the toner image on the second surface is reduced in accordance with the parameter representing the temperature during the cooling operation for cooling the sheet.

Desirably, in the recording medium, in the image formation process, a heating operation of the toner image formed on the second surface is controlled by changing a duty ratio of an on/off pattern of a half-wave cycle in a heating source to heat the toner image formed on the second surface in the fixing of the toner image formed on the second surface.

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

First, the background of the present invention is described in detail.

Figure 1B:
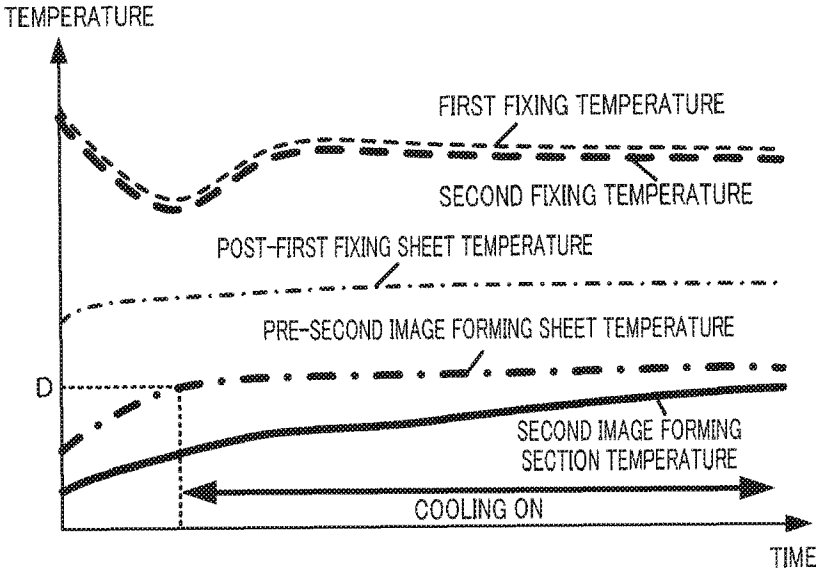
FIG. 1B illustrates an example of temperature characteristics of the image formation system of the case where a cooling control is performed in accordance with a sheet temperature.
Figure 1A:
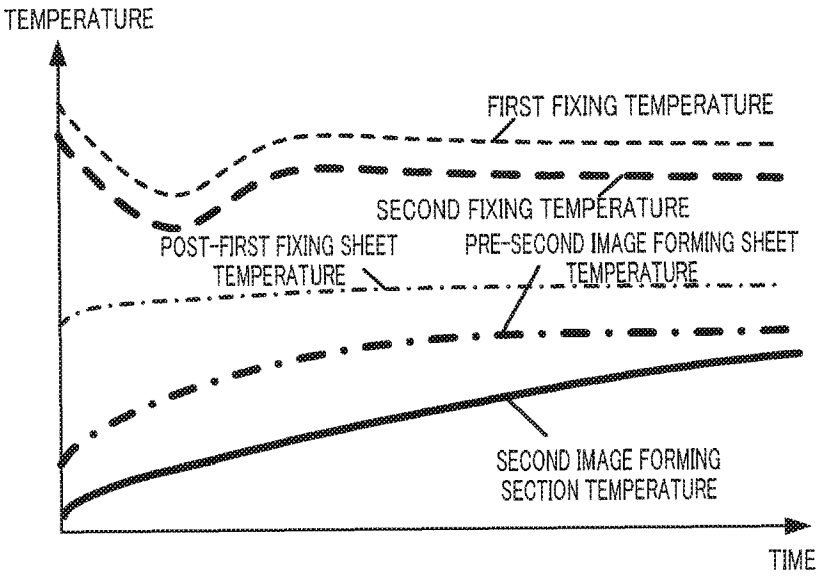
FIG. 1A illustrates an example of temperature characteristics of an image formation system of the case where cooling of sheets is not performed.

FIG. 1A and FIG. 1B illustrate an example of temperature characteristics of a tandem-type image formation system. To be more specific, FIG. 1A and FIG. 1B illustrate examples of the fixing temperature of a fixing section of a preceding machine (hereinafter referred to as "first fixing temperature"), the fixing temperature of a fixing section of a succeeding machine (hereinafter referred to as "second fixing temperature"), the temperature of a sheet fixed at the fixing section of the preceding machine (hereinafter referred to as "post-first fixing sheet temperature"), the temperature of a sheet to be supplied to the image forming section of the succeeding machine (hereinafter referred to as "pre-second image forming sheet temperature"), and the temperature of the image forming section of the succeeding machine (hereinafter referred to as "second image forming section temperature").

FIG. 1A illustrates temperature characteristics of the case where a sheet cooling process is not performed, and FIG. 1B illustrates temperature characteristics of the case where a cooling process is performed in accordance with a pre-second image forming sheet temperature.

It can be said from FIG. 1A that, when the image formation system does not perform the cooling process, the temperature of the image forming section of the succeeding machine (the second image forming section temperature) increases with time. When the image forming section of the succeeding machine is in a high-temperature state, toner fusing occurs, and image defects are caused.

In contrast, in FIG. 1B, the image formation system performs the cooling process based on the temperature of a sheet to be supplied to the image forming section of the succeeding machine (pre-second image forming sheet temperature). For example, the image formation system starts the cooling process when the pre-second image forming sheet temperature is higher than threshold D. It can be said from FIG. 1B that, in comparison with the case where the cooling process is not performed (FIG. 1A), increase of the pre-second image forming sheet temperature is suppressed, and as a result, increase of the second image forming section temperature is suppressed.

It is to be noted that, in comparison with the case where the cooling process is not performed, the fixing temperature of the fixing section of the succeeding machine is required to be increased by the value of the temperature of the sheet reduced by the cooling process to increase the heat value supplied to the sheet. Accordingly, the second fixing temperature of FIG. 1B is higher than the second fixing temperature of the case where the cooling process is not performed (FIG. 1A).

As described above, when the sheet cooling process is performed, the power consumption of the image formation system is increased in the fixing section in the succeeding machine, in addition to the cooling process. In view of this, in image formation systems, it is desired to minimize the cooling process in order to reduce the power consumption.

Incidentally, the temperature of the image forming section of the succeeding machine is changed not only by the temperature of the sheet supplied from the preceding machine, but also by the environment around the apparatus such as the temperature, or by extraneous disturbance factors such as the time variation of the apparatus. In view of this, in the method illustrated in FIG. 1B in which the cooling process is controlled in accordance with the temperature of a sheet to be supplied to the image forming section of the succeeding machine, factors other than the sheet temperature which have influences on the temperature of the image forming section of the succeeding machine are not taken into consideration, and the image formation system can wastefully perform the cooling process.

For example, in FIG. 1B, in the case where the pre-second image forming sheet temperature is higher than threshold D but the temperature of the image forming section of the succeeding machine (the second image forming section temperature) is not high enough to cause image defects, the cooling process executed in the image formation system is a wasteful process. In this case, the power is wastefully consumed also in the fixing section since the fixing temperature of the fixing section of the succeeding machine is set to a higher value, in addition to the cooling process.

In view of this, in the present invention, the image formation system performs a cooling control of sheets in accordance with the temperature of the image forming section of the succeeding machine (the second image forming section temperature). In this manner, the image formation system can control the cooling operation not only in accordance with the sheet temperature but also in accordance with the temperature of the image forming section of the succeeding machine which is under the influence of various disturbances. Thus, it is possible to suppress generation of image defect due to temperature rise in the image forming section of the succeeding machine while minimizing the cooling process. In addition, increase of the heating amount in the fixing section of the succeeding machine can be suppressed, and increase of the power consumption in the cooling process and the fixing section of the succeeding machine can be suppressed.

In the following, the embodiment is described in detail with reference to the drawings.

General Configuration of Image Formation System 10

Figure 2:
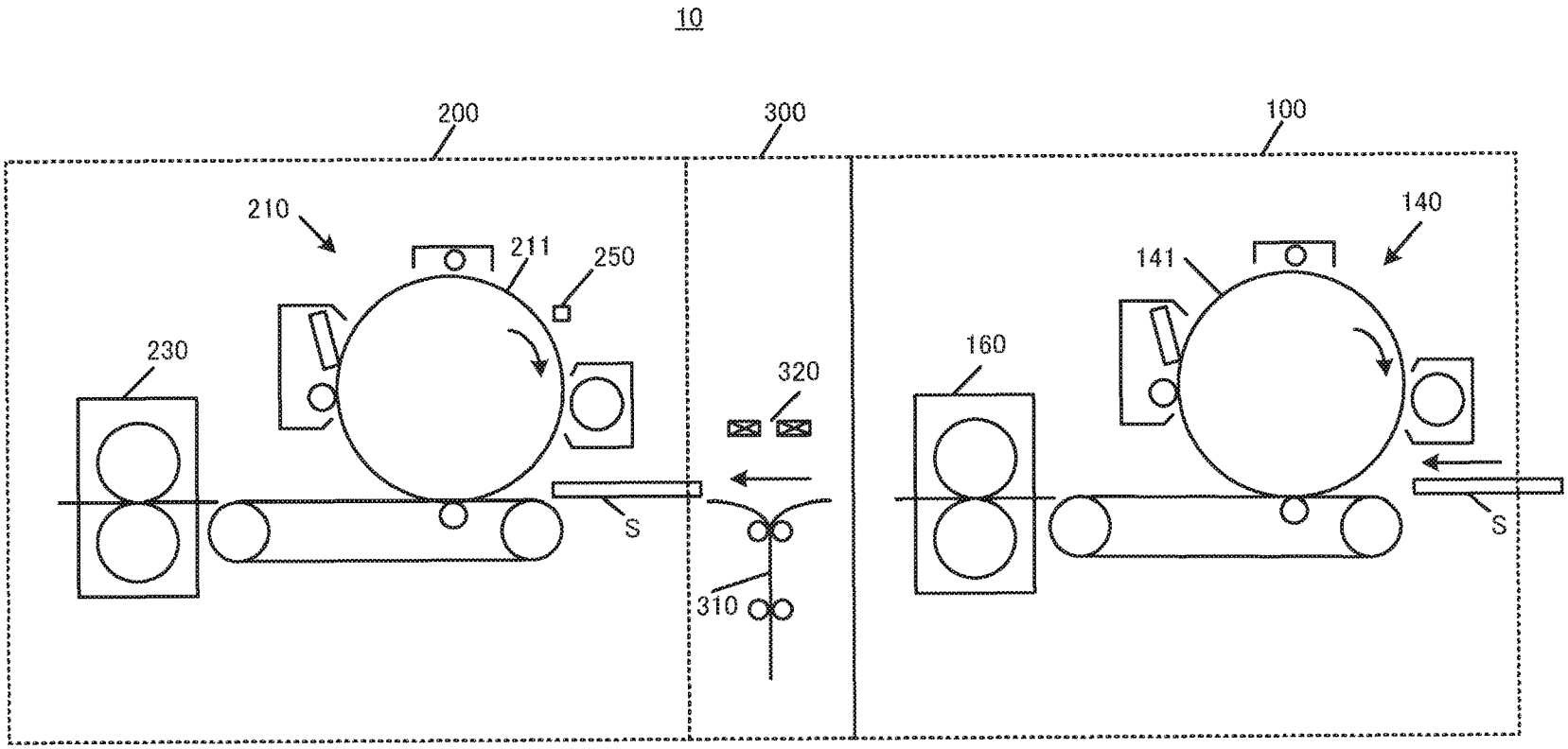
FIG. 2 illustrates a general configuration of the image formation system of the embodiment.

In image formation system 10 illustrated in FIG. 2, first image forming apparatus 100, intermediate conveyance apparatus 300, and second image forming apparatus 200 are connected with each other in this order. It is to be noted that a sheet feed tray unit (not illustrated) may be provided on the upstream side of first image forming apparatus 100, and a post-processing apparatus (not illustrated) may be provided on the downstream side of second image forming apparatus 200. Intermediate conveyance apparatus 300 includes inverting section 310 and cooling section 320. In the drawing, the arrow indicates the conveyance path of sheet S. A system in which two or more image forming apparatuses are connected to each other in tandem as image formation system 10 illustrated in FIG. 2 is generally called a tandem-type image formation system.

When performing double-sided printing, image formation system 10 feeds sheet S from a sheet feed tray unit, and forms a toner image on a first surface (front surface) of sheet S by first image forming apparatus 100 (preceding machine). Thereafter, image formation system 10 inverts sheet S by inverting section 310 of intermediate conveyance apparatus 300, and conveys sheet S to second image forming apparatus 200 (succeeding machine). Then, image formation system 10 forms a toner image on the second surface (rear surface) of sheet S by second image forming apparatus 200. After forming the toner image on the second surface of sheet S, image formation system 10 ejects sheet S.

Configuration of Image Formation System 10

Figure 3:
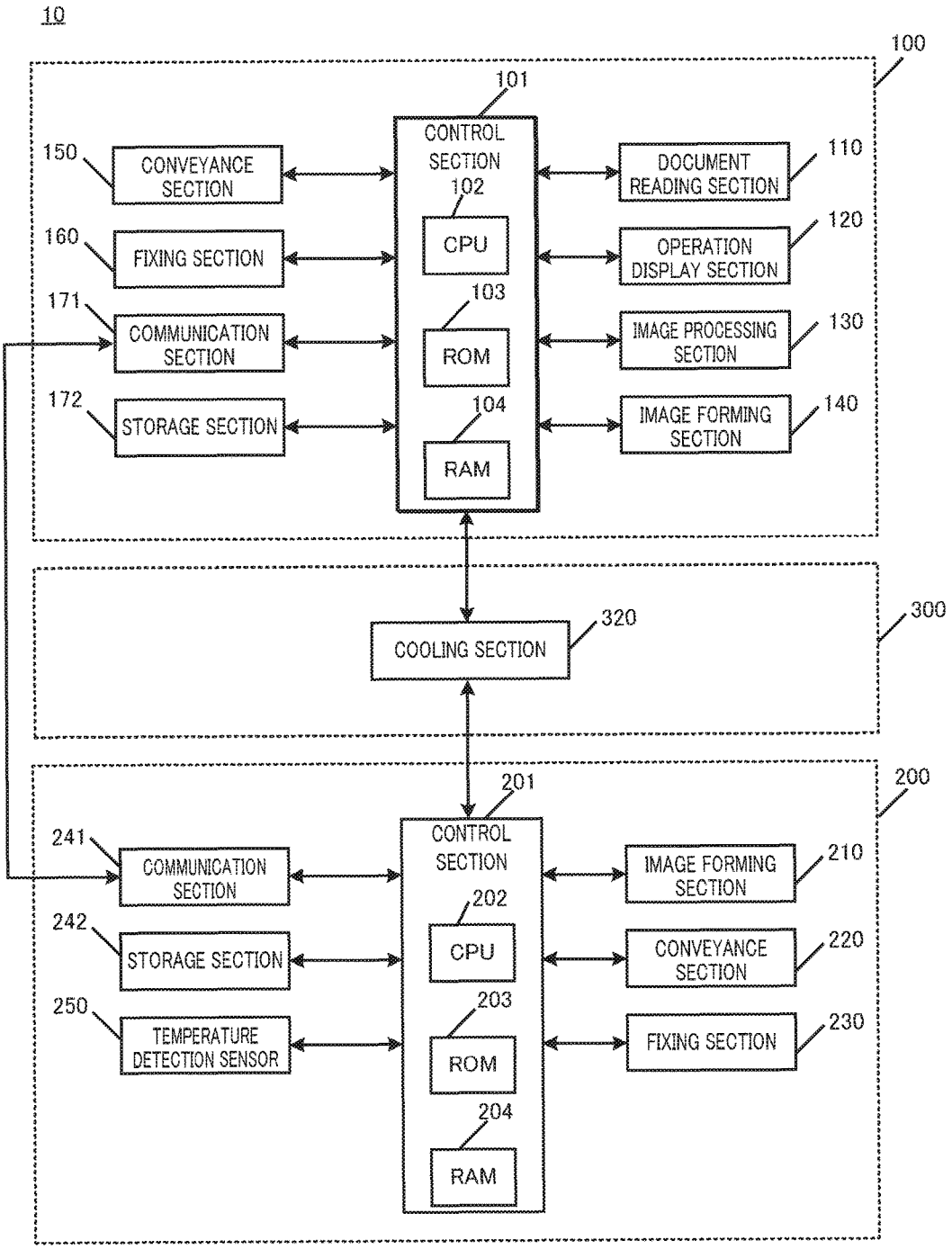
FIG. 3 is a control block diagram of the image formation system of the embodiment.

Next, a configuration of image formation system 10 is described. As illustrated in FIG. 3, image formation system 10 includes first image forming apparatus 100, second image forming apparatus 200 and intermediate conveyance apparatus 300.

First image forming apparatus 100 includes hardware processor 101, document reading section 110, operation display section 120, image processing section 130, image forming section 140 (which functions as "first image forming section" of the embodiment of the present invention), conveyance section 150, fixing section 160 (which functions as "first fixing section" of the embodiment of the present invention), communication section 171, storage section 172, and the like.

Hardware processor 101 includes Central Processing Unit (CPU) 102, Read Only Memory (ROM) 103, Random Access Memory (RAM) 104, and the like. CPU 102 reads out a program corresponding to processing details from ROM 103, loads the program in RAM 104, and performs a centralized control of operations of the blocks of first image forming apparatus 100 in conjunction with the loaded program. At this time, various kinds of data stored in storage section 172 are referenced. Storage section 172 is composed of a nonvolatile-semiconductor memory (so-called flash memory), a hard disk drive, or the like, for example.

Hardware processor 101 exchanges various kinds of data, via communication section 171, with an external apparatus (for example, a personal computer) connected through a communication network such as local area network (LAN) and wide area network (WAN). Hardware processor 101 receives, for example, image data transmitted from the external apparatus, and performs control to form an image on sheet S on the basis of the image data (input image data). Communication section 171 is composed of a communication control card such as a LAN card, for example.

Via communication section 171, hardware processor 101 exchanges various kinds of data with second image forming apparatus 200. In addition, via communication section 171, hardware processor 101, in coordination with hardware processor 201 of second image forming apparatus 200, controls the image formation operation of second image forming apparatus 200, and the cooling operation of cooling section 320 of intermediate conveyance apparatus 300.

Document reading section 110 optically scans a document conveyed onto a contact glass and brings light reflected from a document into an image on a light reception surface of charge coupled device (CCD) sensor, thereby reading the image of the document. It is to be noted that, while the document is conveyed onto the contact glass by an automatic document feeder (ADF), the document may be manually placed on the contact glass.

Operation display section 120 includes a touch screen. Users can perform inputting operation for various kinds of requests and settings from the touch screen.

Image processing section 130 includes a circuit for performing analog-to-digital (A/D) conversion processing and a circuit for performing digital image processing. Image processing section 130 performs A/D conversion processing on an analog image signal acquired by a CCD sensor of document reading section 110 to generate digital image data, and outputs the generated digital image data to image forming section 140.

Image forming section 140 forms a toner image on the first surface of sheet S. To be more specific, image forming section 140 emits laser light based on the digital image data generated by image processing section 130, and irradiates photoconductor drum 141 (image bearing member) with the emitted laser light to form an electrostatic latent image on photoconductor drum 141 (light exposure step).

Image forming section 140 includes configurations for carrying out steps including, in addition to the above-mentioned light exposure step, a charging step that is performed prior to the light exposure step, a development step that is performed after the light exposure step, a transferring step subsequent to the development step, and a cleaning step subsequent to the transferring step.

In the charging step, image forming section 140 uses corona discharge from a charging device to uniformly charge the surface of photoconductor drum 141. In the development step, image forming section 140 causes toner contained in a developer in a developing device to adhere to an electrostatic latent image on photoconductor drum 141, and thus forms a toner image on photoconductor drum 141.

In the transferring step, image forming section 140 transfers the toner image on photoconductor drum 141 to sheet S conveyed by conveyance section 150 including a plurality of conveyance roller pairs. In the cleaning step, image forming section 140 removes the toner remaining on photoconductor drum 141 after the transferring step.

Fixing section 160 applies heat and pressure to the toner image formed on the sheet introduced in the fixing nip part (thermal fixation), thereby fixing the toner image to sheet S (fixing step). Thus, a fixed toner image is formed on the first surface of sheet S.

Second image forming apparatus 200 includes hardware processor 201, image forming section 210 (which functions as "second image forming section" of the embodiment of the present invention), conveyance section 220, fixing section 230 (which functions as "second fixing section" of the embodiment of the present invention), communication section 241, storage section 242, temperature detection sensor 250 (which functions as "detection section" of the embodiment of the present invention) and the like.

It is to be noted that the processes in hardware processor 201, image forming section 210, conveyance section 220, fixing section 230, communication section 241 and storage section 242 of second image forming apparatus 200 are similar to those of hardware processor 101, image forming section 140, conveyance section 150, fixing section 160, communication section 171 and storage section 172 of first image forming apparatus 100, and therefore the descriptions thereof are omitted.

In second image forming apparatus 200, temperature detection sensor 250 is provided in the periphery of image forming section 210. Temperature detection sensor 250 detects the temperature of image forming section 210 (which corresponds to the second image forming section temperature), and outputs temperature information representing the detected temperature to hardware processor 101 through hardware processor 201. The temperature of image forming section 210 is, for example, the surface temperature of photoconductor drum 211 of image forming section 210.

In accordance with the temperature information output from temperature detection sensor 250, hardware processor 101 controls the cooling operation of cooling section 320 of intermediate conveyance apparatus 300. For example, when the temperature represented by the temperature information is equal to or greater than a predetermined temperature (for example, a value within a range of 45 to 50[° C.]), hardware processor 101 determines that image defects can possibly be generated in second image forming apparatus 200, and operates cooling section 320 to cool sheet S.

In addition, in accordance with the temperature information output from temperature detection sensor 250, hardware processor 101 controls the fixation operation of fixing section 230. For example, in accordance with the temperature information, hardware processor 101 sets a setting value (hereinafter referred to as "target temperature") of the fixing temperature of fixing section 230 of the case where cooling section 320 is operated, to a value higher than the target temperature of fixing section 230 of the case where cooling section 320 is not operated. The fixing temperature of fixing section 230 is, for example, the surface temperature of a fixing roller of fixing section 230.

Intermediate conveyance apparatus 300 includes cooling section 320 and the like. Under the control of hardware processor 101, cooling section 320 cools sheet S conveyed from first image forming apparatus 100.

Operation of Image Formation System 10

Figure 4:
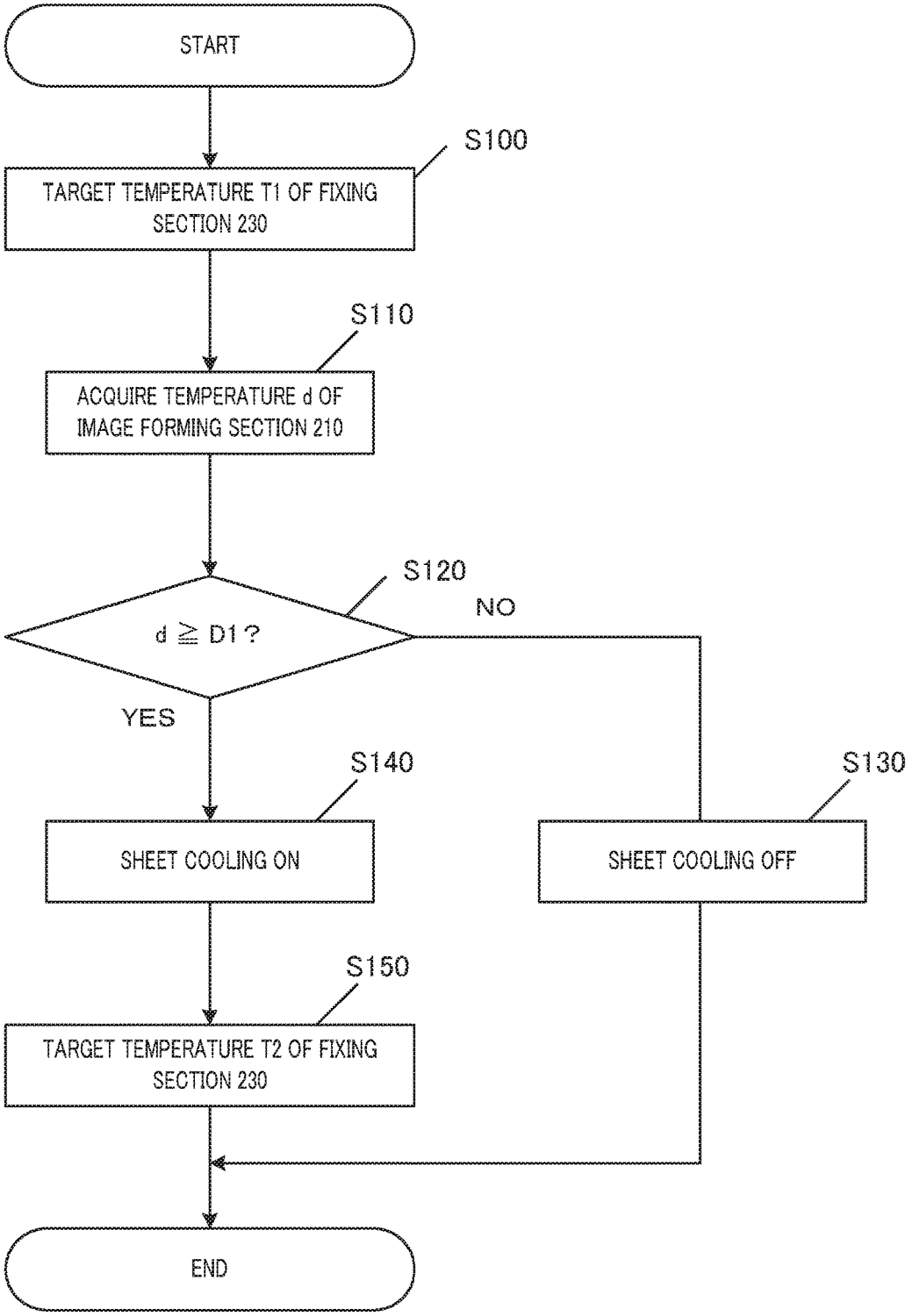
FIG. 4 is a flowchart of an example of an operation of the image formation system of the embodiment.

Next, an operation of image formation system 10 is described in detail with reference to the flowchart of FIG. 4. The processes in the flowchart of FIG. 4 are executed during printing jobs including double-sided printing after activation of image formation system 10.

First, hardware processor 101 sets target temperature T1 of fixing section 230 (for example, 185[° C.]) (step S100). Target temperature T1 is the target temperature of fixing section 230 of the case where the cooling process of cooling section 320 is not performed.

Next, hardware processor 101 acquires temperature information representing temperature d of image forming section 210 from temperature detection sensor 250 (step S110).

Next, hardware processor 101 determines whether temperature d represented by the temperature information is not smaller than threshold D1 (step S120). It is to be noted that threshold D1 may be set to an upper limit value (in a range of 45 to 50[° C.], for example) of the temperature at which image defects are not caused in image forming section 210.

When it is determined that temperature d is smaller than threshold D1 (step S120: NO), hardware processor 101 controls cooling section 320 not to perform the cooling process of sheet S (step S130).

On the other hand, when it is determined that temperature d is equal to or greater than threshold D1 (step S120: YES), hardware processor 101 operates cooling section 320 to cool sheet S (step S140). In addition, hardware processor 101 sets target temperature T2 (for example, 190[° C.]) of fixing section 230 (step S150). Target temperature T2 is a value higher than target temperature T1.

Figure 5:
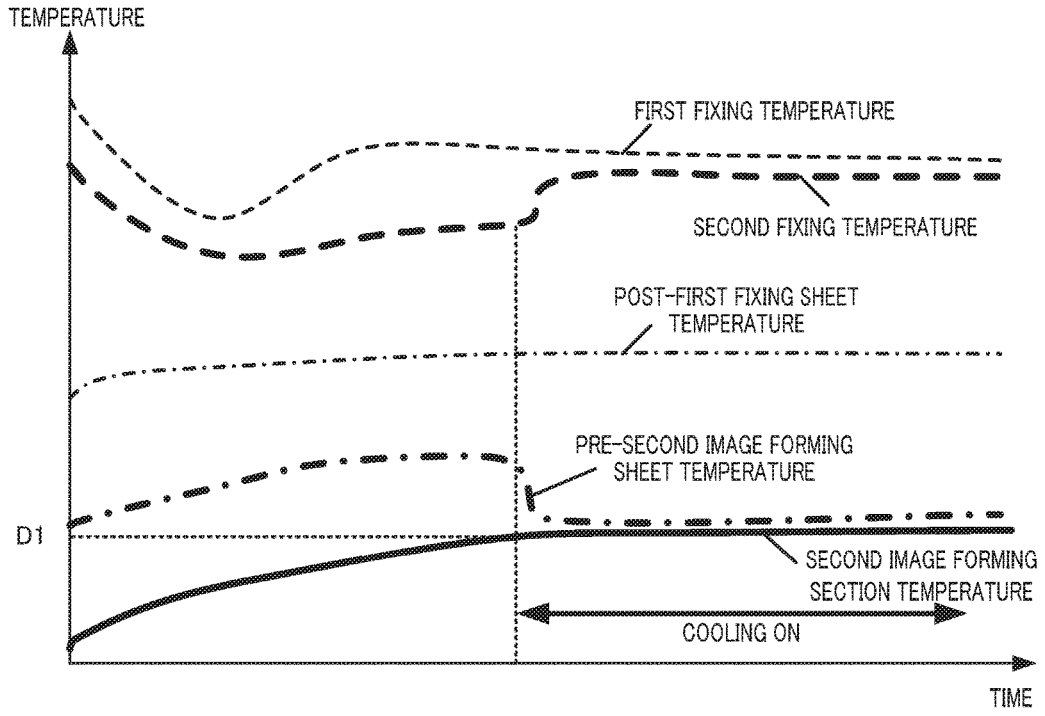
FIG. 5 illustrates an example of the temperature characteristics of the image formation system of the embodiment.

FIG. 5 illustrates an example of the temperature characteristics in image formation system 10. To be more specific, as with FIG. 1A and FIG. 1B, FIG. 5 includes examples of the fixing temperature of fixing section 160 (first fixing temperature), the fixing temperature of fixing section 230 (second fixing temperature), the temperature of a sheet fixed by fixing section 160 (post-first fixing sheet temperature), the temperature of a sheet supplied to image forming section 210 (pre-second image forming sheet temperature), and the temperature of image forming section 210 (second image forming section temperature).

As illustrated in FIG. 5, when the temperature of image forming section 210 (second image forming section temperature) is threshold D1 or greater, image formation system 10 executes a cooling process on sheet S by cooling section 320. When the cooling process is executed, the pre-second image forming sheet temperature is reduced as illustrated in FIG. 5, and increase of the second image forming section temperature is suppressed, and thus, generation of image defects in image forming section 210 can be prevented.

In other words, when the temperature of image forming section 210 is smaller than predetermined threshold D1, image formation system 10 does not perform the cooling process even when the temperature of sheet S supplied to image forming section 210 (pre-second image forming sheet temperature) is increased.

As described above, image formation system 10 controls the cooling operation of cooling section 320 in accordance with the temperature of image forming section 210 and thus can control the cooling in consideration not only of the temperature of sheet S supplied to image forming section 210 but also of various disturbances. For example, in FIG. 5, the period of the cooling process can be reduced in comparison with FIG. 1B (the cooling control in accordance with the temperature of sheet S). That is, image formation system 10 can reduce the power consumption of cooling section 320 by minimizing the cooling process.

Further, as illustrated in FIG. 5, in the period in which the cooling process is not performed, sheet S subjected to heat-fixing at first image forming apparatus 100 and having a high temperature is supplied to fixing section 230 without being cooled, and as a result, the fixing temperature of fixing section 230 (second fixing temperature) is low in comparison with the period in which the cooling process is performed. That is, by minimizing the cooling process, image formation system 10 can suppress increase of the heating amount in fixing section 230 due to the cooling process, and can suppress increase of the power consumption of fixing section 230.

As has been described in detail, in the embodiment, image formation system 10 of a tandem type is to perform an image formation process on a sheet with two image forming apparatuses connected with each other in tandem, and includes: first image forming apparatus 100 including a first image forming section (image forming section 140) that forms a toner image on a first surface of a sheet, and a first fixing section (fixing section 160) that fixes the toner image formed on the first surface; second image forming apparatus 200 including a second image forming section (image forming section 210) that forms a toner image on a second surface of the sheet on which the toner image is formed on the first surface thereof, and a second fixing section (fixing section 230) that fixes the toner image formed on the second surface; cooling section 320 that cools the sheet in a period after the toner image is fixed on the first surface by the first fixing section and before the toner image is formed on the second surface of the sheet by second image forming apparatus 200; and a hardware processor (hardware processor 101) that controls a cooling operation of cooling section 320 in accordance with a parameter representing a temperature of the second image forming section.

According to the above-mentioned configuration of the embodiment, the cooling process of sheet S of cooling section 320 is controlled in accordance with the temperature of image forming section 210, and thus the temperature rise of image forming section 210 can be suppressed. As a result, generation of image defects in the case where a toner image is formed on the second surface of sheet S in image forming section 210 can be prevented.

In addition, in the embodiment, when the temperature of image forming section 210 is smaller than a predetermined temperature, that is, until it is determined that image defects can possibly be generated in image forming section 210, the cooling process is not executed. In this manner, until it is determined that image defects can possibly be generated in image forming section 210, the target temperature of fixing section 230 can be set to a low value, and thus increase of the power consumption of cooling section 320 and fixing section 230 can be suppressed.

That is, according to the embodiment, image formation system 10 can improve the energy efficiency by suppressing the power consumption of cooling section 320 and fixing section 230, and can prevent generation of image defects in image forming section 210 while maintaining the fixation performance of fixing section 230.

Modifications (1) While the cooling control is performed in accordance with the temperature of image forming section 210 (the surface temperature of photoconductor drum 211) in the embodiment, the present invention is not limited to this. Image formation system 10 may perform the cooling control in accordance with a parameter representing the temperature of image forming section 210. The parameter representing the temperature of image forming section 210 may be thermal expansion of photoconductor drum 211 of image forming section 210 as well as the temperature of image forming section 210 (the surface of photoconductor drum 211). Image formation system 10 may detect thermal expansion in accordance with variation of the time required for one rotation (one cycle) of photoconductor drum 211 with use of a phase sensor and the like, for example.

(2) In the embodiment, hardware processor 101 may set a plurality of the thresholds for determining whether the cooling process is executed. For example, hardware processor 101 may increase the cooling performance of cooling section 320 stepwise every time when the temperature represented by the temperature information output from temperature detection sensor 250 exceeds one of the thresholds. Alternatively, when intermediate conveyance apparatus 300 includes a plurality of cooling sections 320, hardware processor 101 may increase the number of cooling sections 320 to be operated every time when the temperature represented by the temperature information exceeds one of the thresholds. Likewise, hardware processor 101 may increase the target temperature of fixing section 230 stepwise every time when the temperature represented by the temperature information exceeds one of the thresholds.

In this manner, hardware processor 101 changes the cooling operation of cooling section 320 and the target temperature of fixing section 230 at a plurality of stages in accordance with the temperature of image forming section 210, and thus can perform the cooling process in accordance with the degree of the temperature rise of image forming section 210 while maintaining the fixation performance of fixing section 230.

(3) In the embodiment, hardware processor 101 may control the cooling operation of cooling section 320 in accordance with the image formation condition. The image formation condition is, for example, the thermal capacity of sheet S, the thermal capacity of a toner image formed on sheet S, or, the ambient temperature of image formation system 10. In addition, the method for controlling the cooling operation of cooling section 320 is setting of threshold D1 for switching ON/OFF of the cooling operation, setting of the cooling temperature of cooling section 320, or the like.

For example, hardware processor 101 may specify the thermal capacity of sheet S based on setting information of sheet S (sheet type, thickness, basis weight, paper size or the like). As the thermal capacity of sheet S increases, the ease of temperature rise of sheet S decreases. In addition, hardware processor 101 may specify the thermal capacity of a toner image on sheet S based on pattern information (such as the coverage rate) of the image formed on sheet S. As the coverage rate increases, the toner amount on sheet S increases and the thermal capacity of the toner image increases. Accordingly, as the thermal capacity of the toner image increases, the ease of temperature rise sheet S on which a toner image is formed decreases.

In view of this, hardware processor 101 correspondingly reduces threshold D1 for operating cooling section 320 as the thermal capacity of sheet S increases. In this manner, hardware processor 101 starts the cooling operation of cooling section 320 for sheet S whose thermal capacity is large at an earlier timing in comparison with sheet S whose thermal capacity is small, and thus can sufficiently reduce the temperature of sheet S at the time point when image forming section 210 is actually set to a high temperature state. In addition, hardware processor 101 may also advance the timing of changing the target temperature of fixing section 230 as well as the timing of starting the cooling operation as the thermal capacity of sheet S increases. In this manner, fixing section 230 can perform the fixation process at a target temperature in accordance with cooling of sheet S, and thus can maintain the optimum fixation performance even with sheet S which requires a larger quantity of heat.

Alternatively, hardware processor 101 may increase the cooling performance for operating cooling section 320 as the thermal capacity of sheet S increases. In addition, hardware processor 101 may correspondingly increase the target temperature of fixing section 230 as the thermal capacity of sheet S increases.

In addition, as the temperature of image formation system 10 increases, the cooling effect of cooling section 320 decreases, and therefore hardware processor 101 may correspondingly increase the cooling performance for operating cooling section 320.

It is to be noted that hardware processor 101 may change the condition for operating cooling section 320 or the target temperature of fixing section 230 in accordance with, in addition to the thermal capacity of sheet S and the temperature of image formation system 10, other parameters such as the productivity of image formation system 10 (the number of sheets per unit time for image formation) and the time for conveying sheet S from fixing section 160 to image forming section 210.

(4) In the embodiment, when the temperature of image forming section 210 is reduced by the cooling operation of cooling section 320 and the possibility of generation of image defects is eliminated, hardware processor 101 may stop the cooling operation of cooling section 320. In this case, hardware processor 101 may separately set threshold D1 for determining the start of the cooling operation of the cooling process, and a threshold (D2) for determining the stoppage of the cooling operation. In other words, the cooling control (on/off of the operation) of hardware processor 101 may have hysteresis characteristics.

For example, it is conceivable that there is a time difference between cooling of sheet S and dropping of the temperature of image forming section 210. Accordingly, in image formation system 10, it is necessary to perform cooling of sheet S in advance before the temperature of image forming section 210 is put to a state where image defects can possibly be generated. On the other hand, cooling of sheet S becomes unnecessary at the time point when the temperature of image forming section 210 is changed from the high temperature state to a state where the image defects are not generated. In view of this, hardware processor 101 may set threshold D1 for operating cooling section 320 to a value lower than threshold D2 for stopping cooling section 320.

(5) In accordance with the image formation condition, hardware processor 101 may switch between the mode described in the embodiment in which the cooling control (the control in accordance with the temperature of image forming section 210) is performed, and a mode in which the cooling operation of cooling section 320 is controlled such that the heat dissipation amount of sheet S is set to a constant value in accordance with the temperature of sheet S after a toner image is fixed on the first surface by fixing section 160. Here, the mode described in the embodiment in which the cooling control is performed is an energy saving priority mode in which reduction in power consumption of cooling section 320 and fixing section 230 is prioritized.

On the other hand, for example, sheet S is conveyed to intermediate conveyance apparatus 300 in the state where the length of the sheet is reduced due to thermal shrinkage or the like during passage through fixing section 160, and thereafter, the length of sheet S is reset in accordance with the heat dissipation amount during passage through intermediate conveyance apparatus 300. That is, since the length of sheet S on which a toner image is formed in second image forming apparatus 200 differs depending on the heat dissipation amount of sheet S in intermediate conveyance apparatus 300, the size or the position of the image can possibly differ between the first surface and the second surface of sheet S. Accordingly, from a view point of the accuracy of the position of the image, it is important to maintain the heat dissipation amount of sheet S at a constant value in conveyance apparatus 300, and therefore the mode for controlling the operation of cooling section 320 in accordance with the temperature of sheet S is the image quality priority mode.

Examples of the image formation condition include setting information of sheet S, information of the pattern of the image to be formed on sheet S, and image adjustment information of the user.

The setting information of sheet S is, for example, the sheet type (such as smoothness and basis weight). As the smoothness of the sheet increases, the image quality required for the printing of the sheet tends to be increased. In view of this, hardware processor 101 may switch the mode to the image quality priority mode when a sheet whose smoothness is high is used, or to the energy saving mode when a sheet whose smoothness is low is used.

In addition, the pattern information of an image is, for example, the coverage rate. As the coverage rate increases, the influence of the difference in image formation process on the image quality increases. In view of this, hardware processor 101 may switch the mode to the image quality priority mode when the coverage rate is high, or to the energy saving mode when the coverage rate is low.

In addition, the image adjustment information of the user is, for example, the frequency of the parameter setting (the number of times of the setting) for image adjustment by the user. It is conceivable that, as the frequency of the setting increases, the image quality requested by the user increases. In view of this, hardware processor 101 may switch the mode to the image quality priority mode when the number of times of the setting of the image adjustment by the user is large, or to the energy saving mode when the number of times of the setting of the image adjustment is small.

(6) In the embodiment, hardware processor 101 may increase the conveyance time of sheet S from fixing section 160 to image forming section 230 in accordance with the temperature of image forming section 210 during the cooling operation of cooling section 320. To be more specific, when sheet S is cooled by cooling section 320 but the temperature of image forming section 210 increases (for example, the temperature exceeds a threshold higher than threshold D1), hardware processor 101 increases the conveyance time of sheet S from fixing section 160 to image forming section 230 to dissipate the heat of sheet S and reduce the temperature of sheet S supplied to image forming section 230, thereby suppressing the temperature rise of image forming section 210.

For example, hardware processor 101 may change the productivity of image formation system 10 (the number of sheets for image formation per unit time) in accordance with the temperature of image forming section 210 during the cooling operation of cooling section 320. To reduce the productivity of image formation system 10, it is possible to adjust the conveyance speed of sheet S from fixing section 160 to image forming section 210. Alternatively, image formation system 10 may include a plurality of paths from fixing section 160 to image forming section 210, and hardware processor 101 may select a longer path as the conveyance path of sheet S to reduce the productivity.

Image formation system 10 can suppress the temperature rise of image forming section 210 by cooling sheet S and adjusting the conveyance time of sheet S, and thus can prevent generation of image defects.

(7) In general, fixing section 230 includes a fixing member (fixing roller) and a heating source (heater) disposed inside the fixing member. When the fixing member is heated by the heating source from the inside, heat is transmitted to the surface of the fixing member, and the fixing member thermally fixes a toner image on sheet S. In the embodiment, hardware processor 101 may control the heating operation (target temperature) of the fixing section by changing the duty ratio of the on/off pattern of a half-wave cycle in the heating source of fixing section 230.

(8) While image formation system 10 includes intermediate conveyance apparatus 300 in the embodiment, the present invention is not limited to this, and the configuration of intermediate conveyance apparatus 300 (inverting section 310 and cooling section 320) may be provided in first image forming section 100 or second image forming section 200.

(9) Image formation system 10 according to the embodiment may be an image formation system that forms a color image, or an image formation system that forms a single-color image (for example, a monochrome image).

While the invention made by the present inventor has been specifically described based on the preferred embodiments, it is not intended to limit the present invention to the above-mentioned preferred embodiments but the present invention may be further modified within the scope and spirit of the invention defined by the appended claims.

What is claimed is:

1. An image formation system of a tandem type that performs an image formation process on a sheet with two image forming apparatuses connected with each other in tandem, the image formation system comprising:

a first image forming apparatus including a first image forming section that forms a toner image on a first surface of the sheet, and a first fixing section that fixes the toner image formed on the first surface;

a second image forming apparatus including a second image forming section that forms a toner image on a second surface of the sheet on which the toner image is formed on the first surface thereof, a second fixing section that fixes the toner image formed on the second surface, and a sensor that detects a parameter representing a temperature of the second image forming section;

a cooling section that cools the sheet in a period after the toner image is fixed on the first surface by the first fixing section and before the toner image is formed on the second surface of the sheet by the second image forming apparatus; and a hardware processor that controls a cooling operation of the cooling section in accordance with the parameter detected by the sensor.

2. An image formation system of a tandem type that performs an image formation process on a sheet with two image forming apparatuses connected with each other in tandem, the image formation system comprising:

a first image forming apparatus including a first image forming section that forms a toner image on a first surface of the sheet, and a first fixing section that fixes the toner image formed on the first surface;

a second image forming apparatus including a second image forming section that forms a toner image on a second surface of the sheet on which the toner image is formed on the first surface thereof, and a second fixing section that fixes the toner image formed on the second surface;

a cooling section that cools the sheet in a period after the toner image is fixed on the first surface by the first fixing section and before the toner image is formed on the second surface of the sheet by the second image forming apparatus; and a hardware processor that controls a cooling operation of the cooling section in accordance with a parameter representing a temperature of the second image forming section, wherein the hardware processor sets a setting value of a fixing temperature in the second fixing section of a case where the cooling section is operated, to a value higher than a setting value of the fixing temperature of a case where the cooling section is not operated.

3. The image formation system according to claim 1, wherein the parameter representing the temperature is a surface temperature of an image bearing member of the second image forming section.

4. The image formation system according to claim 1, wherein the parameter representing the temperature is thermal expansion of an image bearing member of the second image forming section.

5. The image formation system according to claim 1, wherein the hardware processor controls the cooling operation of the cooling section in accordance with an image formation condition.

6. An image formation system of a tandem type that performs an image formation process on a sheet with two image forming apparatuses connected with each other in tandem, the image formation system comprising:

a first image forming apparatus including a first image forming section that forms a toner image on a first surface of the sheet, and a first fixing section that fixes the toner image formed on the first surface;

a second image forming apparatus including a second image forming section that forms a toner image on a second surface of the sheet on which the toner image is formed on the first surface thereof, and a second fixing section that fixes the toner image formed on the second surface;

a cooling section that cools the sheet in a period after the toner image is fixed on the first surface by the first fixing section and before the toner image is formed on the second surface of the sheet by the second image forming apparatus; and a hardware processor that controls a cooling operation of the cooling section in accordance with a parameter representing a temperature of the second image forming section, wherein the hardware processor switches between a first mode and a second mode, the first mode being a mode in which the cooling operation of the cooling section is controlled in accordance with the parameter representing the temperature, the second mode being a mode in which, in accordance with a temperature of the sheet on which the toner image is fixed on the first surface thereof by the first fixing section, the cooling operation of the cooling section is controlled such that a heat dissipation amount of the sheet is constant.

7. The image formation system according to claim 6, wherein the hardware processor switches between the first mode and the second mode in accordance with an image formation condition.

8. The image formation system according to claim 1, wherein, in accordance with the parameter representing the temperature during the cooling operation of the cooling section, the hardware processor lengthens a time period for conveying the sheet from the first fixing section to the second image forming section.

9. The image formation system according to claim 8, wherein, in accordance with the parameter representing the temperature during the cooling operation of the cooling section, the hardware processor lengthens a path for conveying the sheet from the first fixing section to the second image forming section.

10. The image formation system according to claim 8, wherein, in accordance with the parameter representing the temperature during the cooling operation of the cooling section, the hardware processor reduces a conveyance speed of the sheet from the first fixing section to the second image forming section.

11. The image formation system according to claim 1, wherein the second fixing section includes a heating source that heats the toner image formed on the second surface, and the hardware processor controls a heating operation of the second fixing section by changing a duty ratio of an on/off pattern of a half-wave cycle in the heating source.

12. An image formation method for performing an image formation process on a sheet by a first image forming apparatus and a second image forming apparatus connected with each other in tandem, the image formation process comprising:

forming a toner image on a first surface of the sheet and fixing the toner image formed on the first surface in the first image forming apparatus;

detecting a parameter representing a temperature of an image forming section of the second image forming apparatus;

cooling the sheet in accordance with the detected parameter in a period after the toner image is fixed on the first surface and before a toner image is formed on a second surface of the sheet; and forming the toner image on the second surface of the sheet on which the toner image is formed on the first surface thereof, and fixing the toner image formed on the second surface in the second image forming apparatus.

13. A computer-readable recording medium storing a program for causing a computer to execute the image formation method according to claim 12.

14. A computer-readable recording medium storing a program for causing a computer to execute an image formation method for performing an image formation process on a sheet by a first image forming apparatus and a second image forming apparatus connected with each other in tandem, the image formation process comprising:

forming a toner image on a first surface of the sheet and fixing the toner image formed on the first surface in the first image forming apparatus;

cooling the sheet in accordance with a parameter representing a temperature of an image forming section of the second image forming apparatus in a period after the toner image is fixed on the first surface and before a toner image is formed on a second surface of the sheet; and forming the toner image on the second surface of the sheet on which the toner image is formed on the first surface thereof, and fixing the toner image formed on the second surface in the second image forming apparatus, wherein, in the image formation process, a setting value of a fixing temperature in fixation of the toner image formed on the second surface of a case where the sheet is cooled is set to a value higher than a setting value of a fixing temperature of a case where the sheet is not cooled.

15. The recording medium according to claim 13, wherein the parameter representing the temperature is a surface temperature of an image bearing member at a time when a toner image is formed on the second surface.

16. The recording medium according to claim 13, wherein the parameter representing the temperature is thermal expansion of an image bearing member at a time when a toner image is formed on the second surface.

17. The recording medium according to claim 13, wherein, in the image formation process, a cooling operation for cooling the sheet is controlled in accordance with an image formation condition.

18. A computer-readable recording medium storing a program for causing a computer to execute an image formation method for performing an image formation process on a sheet by a first image forming apparatus and a second image forming apparatus connected with each other in tandem, the image formation process comprising:

forming a toner image on a first surface of the sheet and fixing the toner image formed on the first surface in the first image forming apparatus;

cooling the sheet in accordance with a parameter representing a temperature of an image forming section of the second image forming apparatus in a period after the toner image is fixed on the first surface and before a toner image is formed on a second surface of the sheet; and forming the toner image on the second surface of the sheet on which the toner image is formed on the first surface thereof, and fixing the toner image formed on the second surface in the second image forming apparatus, wherein, in the image formation process, switching between a first mode and a second mode is performed, the first mode being a mode in which a cooling operation for cooling the sheet is controlled in accordance with the parameter representing the temperature, the second mode being a mode in which, in accordance with a temperature of the sheet on which the toner image is fixed on the first surface thereof, the cooling operation is controlled such that a heat dissipation amount of the sheet is constant.

19. The recording medium according to claim 18, wherein, in the image formation process, the switching between the first mode and the second mode is performed in accordance with an image formation condition.

20. The recording medium according to claim 13, wherein, in the image formation process, a time period for conveying the sheet from the fixing of the toner image formed on the first surface to the forming of the toner image on the second surface is lengthened in accordance with the parameter representing the temperature during the cooling operation for cooling the sheet.

21. The recording medium according to claim 20 wherein, in the image formation process, a path for conveying the sheet from the fixing of the toner image formed on the first surface to the forming of the toner image on the second surface is lengthened in accordance with the parameter representing the temperature during the cooling operation for cooling the sheet.

22. The recording medium according to claim 20 wherein, in the image formation process, a conveyance speed of the sheet from the fixing of the toner image formed on the first surface to the forming of the toner image on the second surface is reduced in accordance with the parameter representing the temperature during the cooling operation for cooling the sheet.

23. The recording medium according to claim 13, wherein, in the image formation process, a heating operation of the toner image formed on the second surface is controlled by changing a duty ratio of an on/off pattern of a half-wave cycle in a heating source to heat the toner image formed on the second surface in the fixing of the toner image formed on the second surface.

* * * * *